US008571252B2

(12) United States Patent
North et al.

(10) Patent No.: US 8,571,252 B2
(45) Date of Patent: Oct. 29, 2013

(54) DRIVER ASSEMBLY FOR LOUDSPEAKERS

(75) Inventors: Donald J. North, Los Angeles, CA (US); Thomas Richard Farr, Los Angeles, CA (US)

(73) Assignee: GGEC America, Inc., Santa Ana, CA (US)

( * ) Notice: Subject to any disclaimer, the term of this patent is extended or adjusted under 35 U.S.C. 154(b) by 155 days.

(21) Appl. No.: 13/336,882

(22) Filed: Dec. 23, 2011

(65) Prior Publication Data

US 2013/0163806 A1 Jun. 27, 2013

(51) Int. Cl.
*H04R 1/00* (2006.01)

(52) U.S. Cl.
USPC ..... 381/396; 381/420

(58) Field of Classification Search
USPC ..... 381/305, 345, 351, 355, 397
See application file for complete search history.

(56) References Cited

U.S. PATENT DOCUMENTS

| | | | | |
|---|---|---|---|---|
| 4,481,493 | A * | 11/1984 | Kobler et al. | 335/179 |
| 7,206,426 | B1 * | 4/2007 | Julstrom et al. | 381/331 |
| 7,477,757 | B2 * | 1/2009 | Stiles | 381/419 |
| 2005/0041831 | A1 * | 2/2005 | Stiles et al. | 381/412 |
| 2007/0160257 | A1 * | 7/2007 | Stiles | 381/421 |

* cited by examiner

*Primary Examiner* — Brian Ensey
*Assistant Examiner* — Norman Yu
(74) *Attorney, Agent, or Firm* — Fox Rothschild LLP

(57) ABSTRACT

In one embodiment, a loudspeaker system is provided comprising a motor assembly for driving a diaphragm assembly, where the motor assembly includes a pole piece configured to receive an inductance sleeve. The motor assembly also comprises a permanent magnet, a first shorting ring, and a second shorting ring, with the first and second shorting ring being positioned at least partially within an air gap adjacent the pole piece, and with the first ring positioned adjacent a first side of the permanent magnet and the second shorting ring positioned adjacent a second side of the permanent magnet. The permanent magnet preferably is preferably coated with an insulative material, and may also comprise a plurality of arcuate segments.

9 Claims, 6 Drawing Sheets

Section A-A

Section B-B

DRIVER ASSEMBLY FOR LOUDSPEAKERS

BACKGROUND

The embodiments herein relate generally to a loudspeaker system and more specifically to an improved magnet configuration for generating enhanced sound.

The creation of robust hi-fidelity audio not only involves the science of carefully integrating an array of technologies for electronic to acoustic transformation, but also the art of passionately fine-tuning those integrated technologies within an optimized form factor to enrich the acoustic sound into an experience that is astounding to discerning audiophiles and inspiring to all. As such, modern loudspeakers have evolved over the years into truly enviable works of art and science. The invention described herein reflects the passion of combining art and science in a way that enhances the experience even more than what has been produced heretofore.

To appreciate the nuanced improvements described and claimed herein, it is first helpful to set the stage for those improvements by returning to the basics. In that regard, a loudspeaker is device that utilizes an electrical audio signal input to reciprocally drive controlled movement of ambient air to produce sound. The most common form of loudspeaker uses a paper cone supporting an electrical voice coil acting on a permanent magnet. In order to generate the wide range of frequencies necessary to reflect realistic sound, many speaker systems use multiple drivers each covering part of the range of frequencies desired from high to low levels. Ordinary listeners will recognize the driver names of subwoofers for very low frequencies, woofers for low frequencies, mid-range for middle frequencies, tweeters for high frequencies, and where desired, supertweeters for even higher frequencies.

Although different types of speaker drivers exist, one common type of driver employs a magnet surrounding an electrical voice coil to transform electrical input into a mechanical reciprocating motion of the voice coil that drives a diaphragm via a stiffly supported but lightweight carrier. As the voice coil carrier is driven in its reciprocating motion swiftly and repeatedly, the interconnected diaphragm moves with it, creating undulating sound waves perceived by the listeners as audio. The diaphragm is commonly recognized as the "cone" in a traditional mid-range or woofer speaker, or the "dome" of a tweeter design. The focus of the invention described and claimed herein is more on the driver system and less on the arrangement of the diaphragm and associated supports. Suffice it to say that a diaphragm is typically supported with primary and secondary support members that permit the desired reciprocating travel in response to signal input while dampening post-signal vibrations. The primary support member maintains the diaphragm in a centered and suspended position above the driver, while the secondary support centers and aligns the voice coil carrier that is connected to the diaphragm and serves to restore the voice coil and the diaphragm to a neutral position after moving. An inventive diaphragm arrangement is described in co-owned and co-pending application Ser. No. 13/283,529 filed on Oct. 27, 2011,the entire contents of which are incorporated herein by reference.

Regarding the driver system, a typical voice coil resides suspended within a cylindrical space or gap in a permanent magnet arrangement. When an electrical signal is applied to the voice coil, a magnetic field is created in the gap by the electric current in the voice coil, making it a variable electromagnet. Moreover, consideration of the appropriate materials for the components is important because of their impact on the distortion to the magnetic field and the impedance on the voice coil. In that regard, it may be helpful to refer to, among other publications, Bowler, J. R., *A Theoretical Analysis of Eddy-Current Effects in Loudspeaker Motors,* 48 J. Audio Eng. Soc., No. 7/8 (2000).

The electromagnetic field produced by the current through the coil is perpendicular to the permanent magnetic field in the air gap, generating a mechanical force that causes the voice coil (and thus the diaphragm) to reciprocate within the gap to create sound waves. The suspension system keeps the coil centered in the gap and provides a restoring (centering) force that returns the cone to a neutral position after moving. The permanent magnet is supported within a frame, sometimes referred to as a basket. The voice coil is oriented coaxially inside the gap; it moves back and forth within a small circular volume (a hole, slot, or groove) in the magnetic structure. The gap establishes a concentrated magnetic field between the two poles of a permanent magnet; the outside of the gap being one pole, and the center post, often called the pole piece, being the other. The pole piece and back plate are often manufactured as a single piece called a yoke.

The size and type of magnet and the particulars of the magnetic circuit may be different, depending on design goals. For instance, the shape of the pole piece affects the linearity of the magnetic field in the gap in which the voice coil operates. Likewise, different magnet structure geometries can improve the magnetic field stability dynamically when current is flowing through the coil. Often a shorting ring is employed to oppose fields induced by the coil. The benefits of a shorting ring include reduced impedance at high frequencies, providing extended treble output, reduced harmonic distortion, reduced inductance variation with voice coil movement, and a reduction in magnetic flux modulation that typically accompanies large voice coil excursions. To minimize modulation distortion of the magnetic field in the air gap, a shorting ring may be positioned below the permanent magnet.

Historically, permanent magnets that are configured in a cylindrical configuration have suffered from misaligned magnetic domains, reducing the effectiveness of the permanent magnet to impact reciprocating movement of the voice coil. It has been determined that manufacturing the permanent magnet into discrete, sintered, arcuate components, that are configured to be joined end-to-end into a cylinder, permits a greater alignment of magnetic domains and enhances effectiveness. Each arcuate component, or arc, is conventionally coated with a conductive coating, such as nickel, to reduce corrosion of the underlying magnet material. Although the result is beneficial to durability, the nickel tends to generate an undesired eddy-current.

The present invention comprises embodiments that overcome some of the limitations of the prior art systems, each of which may achieve some or all of the benefits afforded by the present invention.

SUMMARY

In embodiments of the present invention, a speaker system is provided that reduces distortion caused by modulation of the magnetic field within the air gap in a driver assembly as well as reduces eddy currents. Numerous embodiments are contemplated by the present invention, with some described in more detail below. In one embodiment, a loudspeaker system is provided comprising a motor assembly for driving a diaphragm assembly, where the motor assembly includes a pole piece configured to receive an inductance sleeve. The motor assembly also comprises a permanent magnet, a first shorting ring, and a second shorting ring, with the first and second shorting ring being positioned at least partially within an air gap adjacent the pole piece, and with the first ring positioned adjacent a first side of the permanent magnet and the second shorting ring positioned adjacent a second side of the permanent magnet. Preferably, but optionally, the permanent magnet comprises a plurality of arcuate segments coated with an insulative material. By coating the individual permanent magnet components with an insulating material, such as an epoxy, the individual components become insulated from each other to a significant degree, thus reducing an eddy-current effect that would otherwise result from un-insulated components.

In one of many contemplated alternative loudspeaker systems, a motor assembly for driving a diaphragm assembly comprises a permanent magnet and a first shorting ring, where the permanent magnet comprises a plurality of arcuate segments coated with an insulative material. Preferably, but optionally, the loudspeaker system further comprises a second shorting ring, with the second shorting ring being positioned at least partially within an air gap adjacent the pole piece, and with the first ring positioned adjacent a first side of the permanent magnet and the second shorting ring positioned adjacent a second side of the permanent magnet.

BRIEF DESCRIPTION OF THE FIGURES

The detailed description of some embodiments of the invention will be is made below with reference to the accompanying figures, wherein like numerals represent corresponding parts of the figures. Importantly, any gray-scale coloring reflected in the figures is strictly for the reader's ease of visibly distinguishing discrete components, rather than denoting any limiting feature or material.

DETAILED DESCRIPTION OF CERTAIN EMBODIMENTS

Figure 1:
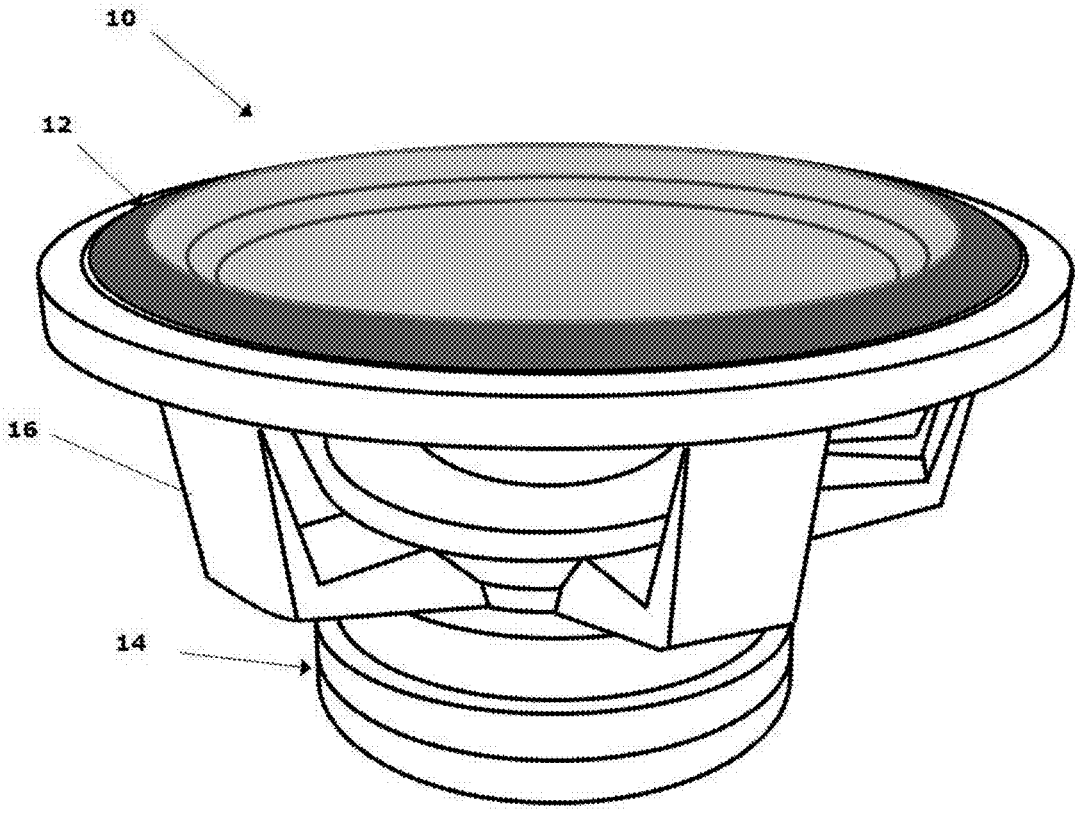
FIG. 1 is a schematic perspective view of a first embodiment loudspeaker.
Figure 2:
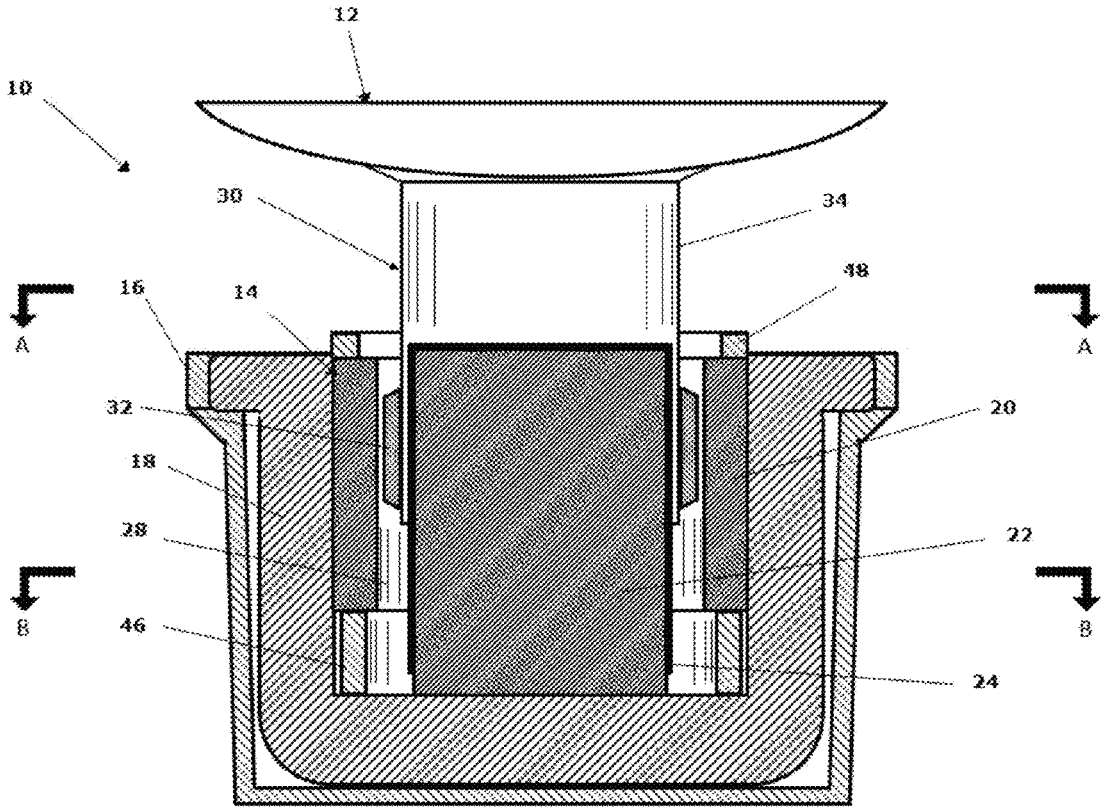
FIG. 2 is a schematic elevational view of the embodiment of FIG. 1.
Figure 3:
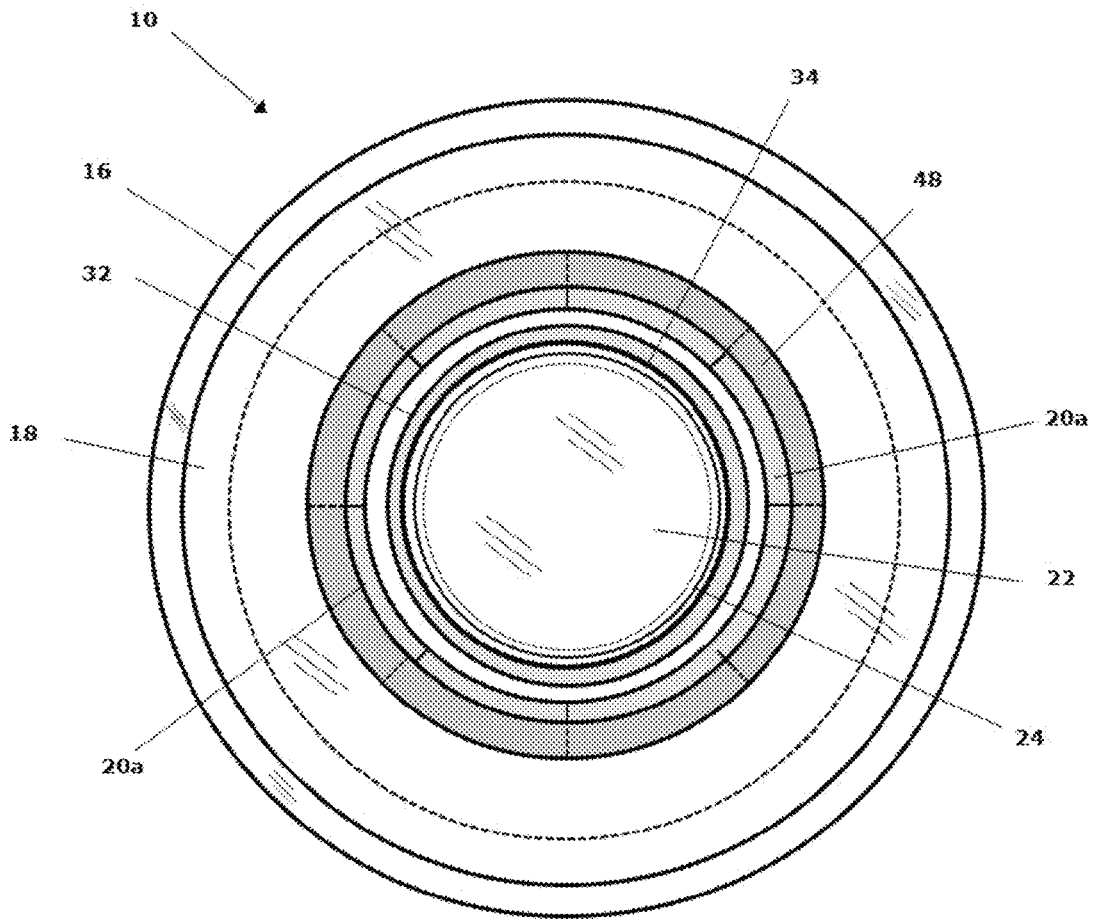
FIG. 3 is a schematic cross-section at line A-A of the embodiment shown in FIG. 2.
Figure 4:
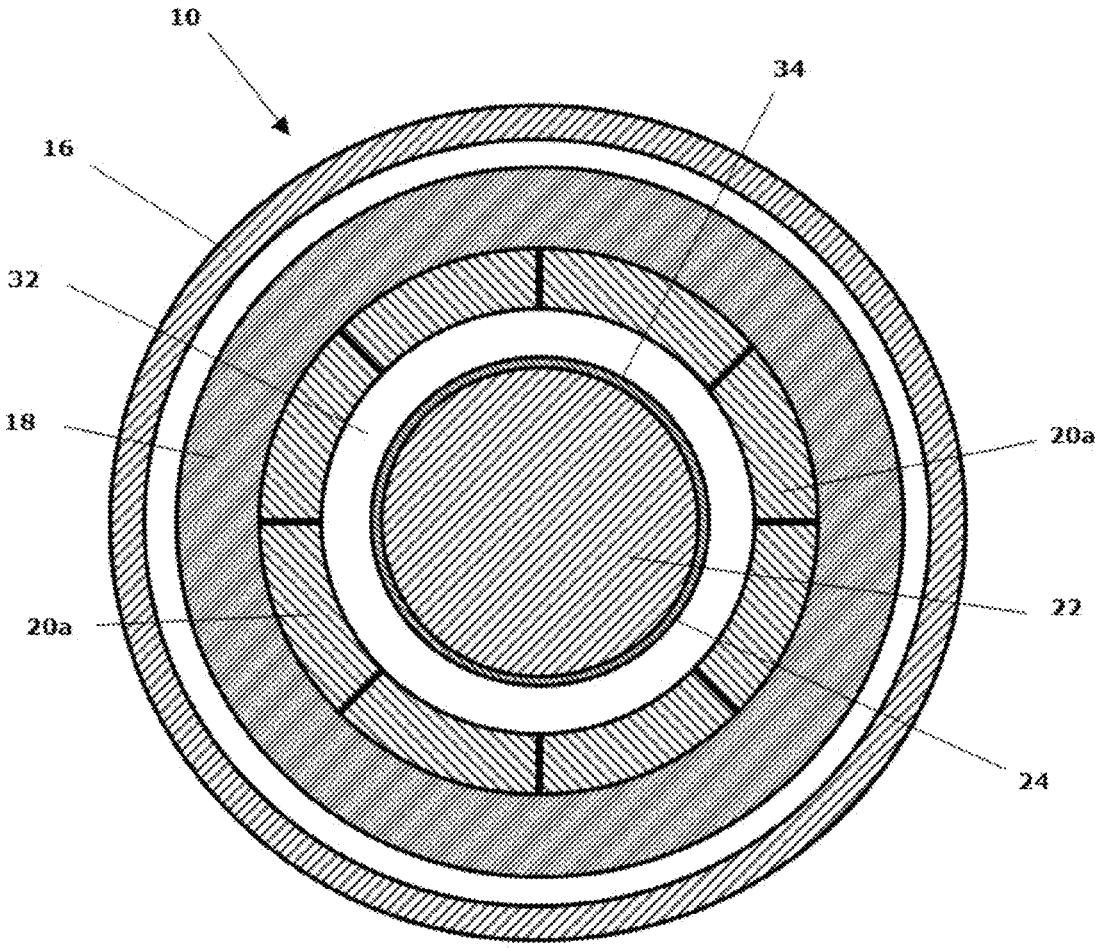
FIG. 4 is a schematic cross-section at line B-B of the embodiment shown in FIG. 2.

By way of example, and referring to FIG. 1, one embodiment of the present invention is a loudspeaker system 10 comprising a diaphragm assembly 12 comprising a diaphragm, surround and spider, each of which may comprise one of numerous possible arrangements and configurations. The loudspeaker system 10 further comprises a motor assembly 14 housed together with the diaphragm assembly in a housing or basket 16, comprising one of numerous possible configurations. With reference to FIGS. 2-4, details of one embodiment, illustrated for example only in FIG. 1, may be described.

In that regard, FIG. 2 illustrates a schematic cross-sectional elevational view of the motor assembly 14 within the housing 16. More specifically, the motor assembly 14 comprises, in one embodiment, a motor case 18 having a generally cylindrical cup-like configuration, although other configurations are contemplated. Enclosed within the motor case 18 includes a permanent magnet 20 having a generally annular shape and comprising, in one preferred embodiment, a plurality of arcuate sections (see 20*a* in FIGS. 3 and 4) that are aligned to form the generally annular shape. The number of arcuate sections 20*a* may be varied depending upon design constraints and goals, but consists of, for purposes of illustrating a first embodiment, eight discrete portions. In the embodiment illustrated, each arcuate section 20*a* comprises an arc of about 45°, although they need not be identical in arcuate dimensions.

The motor assembly 14 further comprises a centrally-positioned pole piece 22 having a generally cylindrical configuration and partially enclosed by an optional inductance sleeve 24. In one embodiment, the motor case 18 and the pole piece 22 are made of steel, the permanent magnet 20 comprises a ferrous alloy, and the optional inductance sleeve 24 may be made of annealed copper, although each of these components may be made with other materials and/or alloys thereof.

With regard to the permanent magnet 20, which is traditionally coated with nickel or similar material, embodiments of the present invention comprise a plurality of permanent magnet arcuate sections 20*a* coated with epoxy or other types of insulating material. Using an insulating material reduces undesirable eddy currents within the magnetic field within the air gap 28 created by the permanent magnet 20. Importantly, the insulative coating may be used regardless of whether the magnet 20 comprises discrete arcuate sections or is monolithic in construction.

The motor assembly further comprises an air gap 28 separating a voice coil assembly 30 from the permanent magnet 20 and motor case 18. The voice coil assembly 30 may be of any conventional size and configuration, but preferably comprises a voice coil 32 and a bobbin 34, to which the diaphragm assembly 12 is connected to transfer reciprocating motion during operation. The details of the voice coil assembly 30 and the diaphragm assembly 12 are not presented here and may be configured as design goals and constraints dictate. Nonetheless, as expected, the motor assembly 14 is configured to cause reciprocating axial movement of the diaphragm assembly 12 through the voice coil assembly 30. By doing so, the diaphragm assembly 12 generates sound waves through the pressure exerted on the ambient air.

The motor assembly 14 preferably further comprises a first shorting ring 46, and a second shorting ring 48, each comprising a generally annular shape and preferably comprising copper material. The shorting rings 46, 48, function to, among other benefits, reduce modulation distortion of the magnetic field caused by the electromagnetic field from the voice coil 34. Preferably, the first shorting ring 46 is positioned within the bottom of an upright motor case 18 on top of which may be placed the permanent magnet 20, while the second shorting ring 48 rests on top of the permanent magnet. The magnet and shorting rings made be adhered together by conventional means. It should be noted that the size and configuration of each shorting ring 46, 48 may be varied and may be optimized depending upon loudspeaker design and constraints. For example, in the embodiment illustrated, the first shorting ring 46 comprises a diameter smaller than that of the permanent magnet 20 and having a smaller thickness as well. Also, by way of example only, the second shorting ring of the embodiment illustrated comprises a diameter the same as or similar to that of the permanent magnet 20 and also having a smaller thickness as well. The second shorting ring 48 may be positioned so as to extend above the motor case, as shown, or flush with or below the motor case.

It should be noted that embodiments generally exemplified by the embodiment of FIGS. 1 through 4 may comprise either a second shorting ring 48 or a plurality of insulative-coated arcuate sections 20*a* of permanent magnet, or both. In other words, it is contemplated that one embodiment may comprises only a first shorting ring and a plurality of insulative-coated permanent magnet arcuate sections 20*a*,and another embodiment may comprises a second shorting ring but a unitary permanent magnet or a sectioned permanent magnet coated with a conventional metallic coating, such as nickel. The exemplary embodiment of FIGS. 1-4, as described herein, reflect both features. Each feature independently produces enhanced sound, but the combination is perceived to be better.

Figure 5:
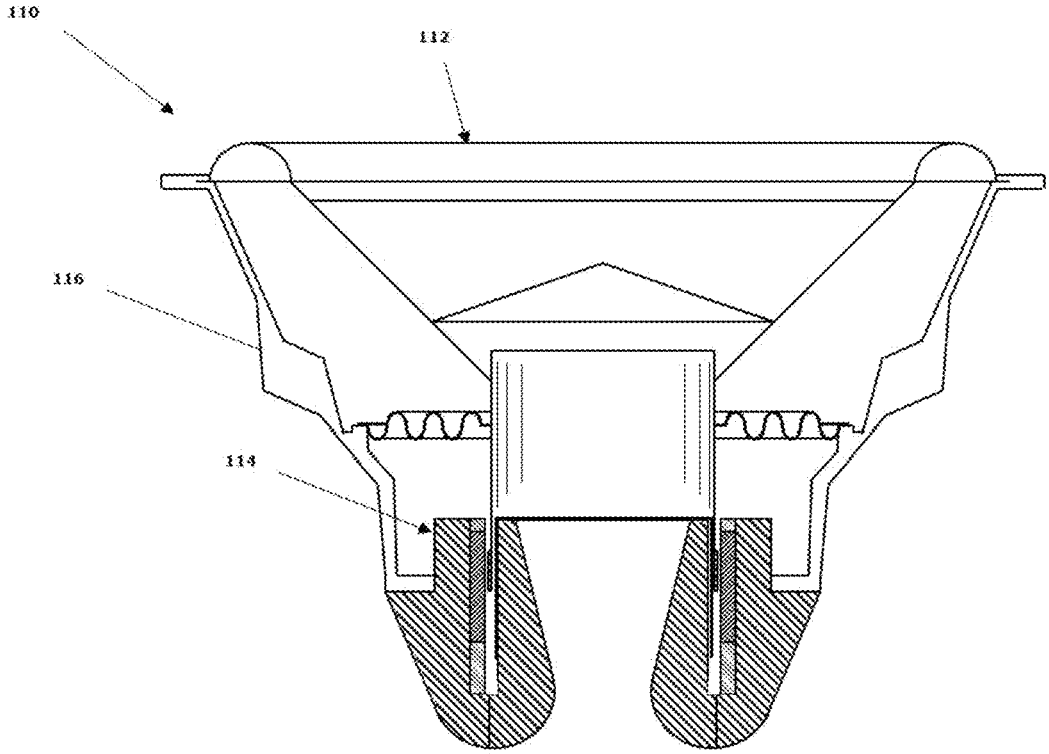
FIG. 5 is a schematic elevational view of a second embodiment.
Figure 6:
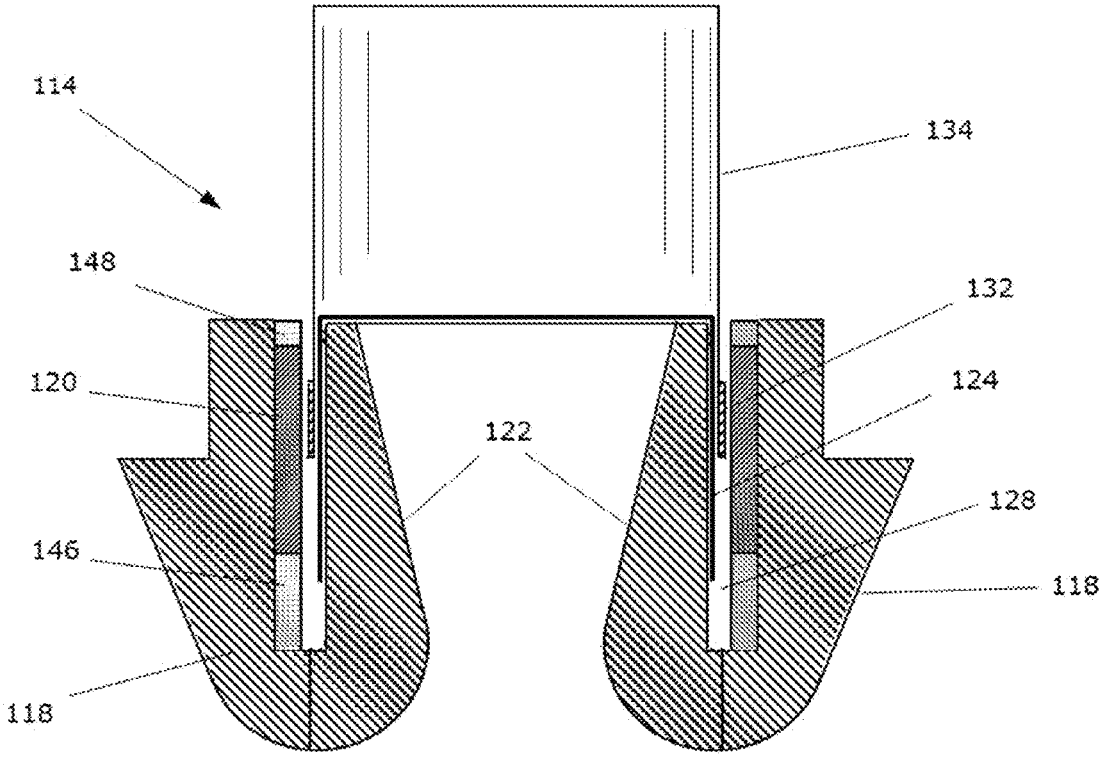
FIG. 6 is a close up view of a portion of the loudspeaker of FIG. 5.

Referring to FIGS. 5 and 6, an alternative embodiment loudspeaker system 110 may be described. By way of example, alternative embodiment 110 comprises a diaphragm assembly 112 and a motor assembly 114 supported within housing 116. As with the embodiments of FIGS. 1-4, the diaphragm assembly may be one of numerous possible configurations and arrangements. The housing may be of the conventional basket configuration, or of any other desirable configuration sufficient to support in a stable fashion a sound assembly and a driver assembly.

Referring to FIG. 6 specifically, a close-up can be seen of one example of motor assembly 114, which comprises a generally annular yoke 118 coupled mechanically via adhesion to generally annular pole piece 122, both of which may be made of steel or other acceptable material. The pole piece is preferably partially enclosed within an inductance sleeve 124, preferably made of copper or other appropriate material. The motor assembly 114 further comprises a permanent magnet 120 positioned within an air gap 128 defined by a pocket between the yoke 118 and pole piece 122. The permanent magnet is positioned and configured for axially driving a voice coil 132 and bobbin 134 reciprocally, in a manner discussed above. The permanent magnet 120 may be of unitary annular configuration, or it may comprise a plurality of arcuate segments, as described above. In one embodiment, a first shorting ring 146 is provided and configured as an annular component positioned below the permanent magnet 120 within air gap 128. The first shorting ring is preferably positioned at the base of the air gap 128 and adhered to a shoulder on the yoke 118 and/or pole piece 122. The motor assembly 114 may further comprise a second shorting ring 148 preferably having an annular configuration and positioned above the permanent magnet 120. As explained above with respect to embodiments described in association with FIGS. 1 through 4, both the second shorting ring and the arcuate magnet segments present benefits to enhance the quality of sound in a loudspeaker by reducing modulation distortion in the magnetic field and in reducing eddy currents. Thus, embodiments comprising one or the other or both features present improvements over prior loudspeaker designs.

Alternative embodiments are contemplated without departing from the spirit of the invention described and claimed herein. In the world of audiophiles, as noted above, speaker designs present an important combination of science and art. Although there are not necessarily many parts within a speaker assembly, every part matters. By that it is meant that the parts are designed and joined in a way that is mutually synergistic to produce repeatable, reliable, high-fidelity sound across a range of wavelengths. The invention herein, as reflected by exemplary embodiments presented, capitalizes not just on optimizing those few parts, but ensuring the synergy demanded by consumers of fine audio output by including an inventive configuration of components.

What is claimed is:

1. A loudspeaker system comprising a motor assembly for driving a diaphragm assembly, the motor assembly including a pole piece configured to receive an inductance sleeve, the motor assembly comprising at least one permanent magnet component, a first shorting ring, and a second shorting ring, the first and second shorting ring being positioned at least partially within an air gap adjacent the pole piece, the first ring positioned adjacent a first side of the at least one permanent magnet component and the second shorting ring positioned adjacent a second side of the at least one permanent magnet components such that all permanent magnet components of the motor assembly are located between the first and second shorting rings.

2. The loudspeaker system of claim 1, wherein the at least one permanent magnet component comprises an insulative coating material.

3. The loudspeaker system of claim 2, wherein the at least one permanent magnet component comprises a plurality of arcuate segments.

4. The loudspeaker system of claim 1, further comprising an inductance sleeve.

5. A loudspeaker system comprising a motor assembly for driving a diaphragm assembly, the motor assembly including a pole piece configured to receive an inductance sleeve, the motor assembly comprising a permanent magnet and a first shorting ring, the permanent magnet being coated with an insulative material, and the magnet and first shorting ring being positioned within an air gap adjacent the pole piece.

6. The loudspeaker system of claim 5, wherein the permanent magnet comprises a plurality of arcuate segments.

7. The loudspeaker system of claim 5, further comprising a second shorting ring, the second shorting ring being positioned at least partially within an air gap adjacent the pole piece, the first ring positioned adjacent a first side of the permanent magnet and the second shorting ring positioned adjacent a second side of the permanent magnet.

8. The loudspeaker system of claim 5, further comprising an inductance sleeve.

9. The loudspeaker system of claim 1, wherein the at least one permanent magnet component comprises a metallic plating.

* * * * *